US005333852A

United States Patent [19]

Milillo et al.

[11] Patent Number: 5,333,852

[45] Date of Patent: Aug. 2, 1994

[54] AUTO PAPER SIZE SENSING MECHANISM FOR AN ADJUSTABLE CASSETTE

[75] Inventors: William D. Milillo, Ontario; Gregory P. Miller, Rochester, both of N.Y.

[73] Assignee: Xerox Corporation, Stamford, Conn.

[21] Appl. No.: 93,025

[22] Filed: Jul. 19, 1993

[51] Int. Cl.[5] ..... B65H 1/00

[52] U.S. Cl. ..... 271/171

[58] Field of Search ..... 271/171, 253, 255

[56] References Cited

FOREIGN PATENT DOCUMENTS

| | | | |
|---|---|---|---|
| 66030 | 3/1988 | Japan | 271/171 |
| 185730 | 8/1988 | Japan | 271/171 |
| 166129 | 7/1991 | Japan | 271/171 |

*Primary Examiner*—Robert P. Olszewski
*Assistant Examiner*—Boris Milef

[57] ABSTRACT

An adjustable sheet cassette for use in apparatus feeding sheets and being movable in the apparatus from a sheet feeding position to a nonsheet feeding position, the adjustable cassette having a sheet stack support platform capable of supporting stacks of sheets of a plurality of length and width dimensions, at least one sheet edge guide movable in a path in the cassette to accommodate stacks of sheets of different length or width dimensions, the sheet edge guide having attached thereto an actuator arm having a plurality of switch actuators for selectively actuating a plurality of switches on a circuit board on the main body of the apparatus when the cassette is in sheet feeding position in the apparatus, the actuators being located to selectively actuate the switches on the main body of the apparatus which represent one of a plurality of sheet sizes, whereby when each of the switches is actuated it generates a unique resistance in the circuit on the circuit board, the resultant of these unique resistances determining a resultant voltage signal to the main controller on the main body of the apparatus which allows the controller to interpret the length or width dimension of the sheets in the sheet cassette.

18 Claims, 6 Drawing Sheets

AUTO PAPER SIZE SENSING MECHANISM FOR AN ADJUSTABLE CASSETTE

BACKGROUND OF THE INVENTION

The present invention relates to sheet feeding apparatus and in particular to an adjustable sheet cassette capable of housing stacks of sheets or similar materials of different sizes.

In a particular application, the adjustable sheet cassette of the present invention has utility as a supply of stacked sheets in automatic printing apparatus such as reproducing apparatus including copiers, and electronic printers. Typically, in these devices, individual sheets of copy paper are separately fed through the copier and processed one at a time. In this process, it is convenient to have a supply stack of sheets from which to feed the individual sheets. Modern day business desires require that a copier or printer be capable of faithfully reproducing original documents of various sizes or configurations on various types of copy stock. To facilitate this operational flexibility, it has been customary to provide a supply of cut sheets in a cassette-type form. These paper sheet cassettes may be designed for a single fixed size of paper in which case they are only used for storing sheets of that size in the printing apparatus. Alternatively, adjustable cassettes may be designed to enable customer adjustment of the cassette for a variety of different sheet sizes. With the fixed size cassette if a printing operation is to be performed to obtain prints on a copy sheet size of a size other than that which is in the fixed cassette, the cassette must be removed from the machine and replaced with another cassette of a different fixed size to enable the operation to be completed. Similarly, with an adjustable cassette, if the size of the paper in the cassette is unsuitable for a particular printing operation, the copy sheets should be removed and replaced with the appropriate size copy sheets for that particular printing operation.

It is desirable that the printing apparatus know the size of the sheets in the cassette as soon as it is inserted in the printing machine. This enables the machine to automatically display the copy sheet size on the control panel to tell an operator if a particular job run can be run with the copy sheet size in the cassette or to replace the copy sheet supply. For example, it enables the operator to determine if the automatic printing machine is capable of providing size for size reproduction or automatic reduction and/or automatic enlargement of an original that may be placed on the copying platen.

For the larger, higher volume, higher speed machines, the size of a sheet in a typical, adjustable cassette, is typically determined by providing separate switches on two sides of the cassette, each with a separate input to the controller on the main body of the machine which requires wiring harnesses, plugs, etc. that must be connected after the cassette has been loaded into the automatic printing machine. Not only is this a relatively complicated procedure and expensive, but it involves an electrical connection which can easily become contaminated by dirt, toner or other debris, or otherwise damaged.

In the smaller, slower, lower volume machines, the size of the sheets in an adjustable cassette, may be entered into the control panel of the machine by the operator manually pressing a button or turning a dial, or alternatively, by the operator manually moving a sheet size indicator on the cassette, which in fact may be totally independent of the size sheet which is actually in the cassette. It frequently happens that the operator in either circumstances selects the wrong size. This permits the condition to exist where the machine interpretation of the size of the sheets in the cassette does not match the size of the sheets in the cassette and thereby leads to copy quality defects, productivity losses, in that paper jams may occur which may lead to shutting down the entire printing operation. The present invention is directed to a mechanism for automatically identifying the sheet size in an adjustable cassette without requiring any switches, wires, plugs, etc. on the cassette which have to be plugged into the machine.

PRIOR ART

U.S. Pat. No. 4,786,042 to Stemmle describes an adjustable size sensing sheet cassette, wherein rear edge and side edge sheet guides are movable to a plurality of positions representing a plurality of sheet, width and length dimensions and have associated therewith sheet, width and length dimension representing members on the bottom of the cassette whose position is controlled by a camming slot arrangement on the bottom of the cassette. The position of the two members is detected by detectors on the main body of the machine and the controller determines from their position the length and width dimensions of the copy sheets in the cassette.

SUMMARY OF THE INVENTION

A principle aspect of the present invention is to provide an automatic sheet size sensing mechanism to provide improved sheet feeding reliability by preventing a situation where the sheet feeding apparatus does not know what size paper is in the sheet cassette.

It is further aspect of the present invention to provide a simple, low cost device which automatically enables the machine to interpret what size paper is currently loaded in a universal paper supply cassette or drawer, which enables automatic reduction and enlargement, as well as automatic size selection to match copy size to original size.

It is a further aspect of the present invention to provide a switch actuating mechanism on a universal sheet cassette that selectively actuates switches on the main body of the sheet feeding apparatus to enable it to interpret what size paper is loaded in each cassette.

In a further specific aspect of the present invention an adjustable sheet cassette for use in a sheet feeding apparatus comprises a sheet stack support platform capable of supporting a stack of sheets of a plurality of length and width dimensions, at least one sheet edge guide movable in a path in the cassette to accommodate stacks of sheets of different length and width dimensions and having attached thereto an actuator arm having a plurality of switch actuators for selectively actuating a plurality of switches on a circuit board on the main body of the apparatus when the cassette is in the sheet feeding position in the apparatus; the actuators being located to selectively actuate the switches on the main body of the apparatus which represent one of a plurality of sheet sizes, each of the switches, when actuated generating a unique resistance in the circuit on the circuit board, the resultant of said unique resistances determining a resultant voltage signal to the main controller on the main body of the apparatus which allows the controller to interpret the length and width dimensions of the sheets in the sheet cassette.

In a further aspect of the present invention the actuators are on an actuator arm attached to the sheet edge guide which is movable in a path parallel to the path of motion of the sheet edge guide.

In a further aspect of the present invention the path of motion of the sheet edge guide is perpendicular to the path of motion of the sheet cassette from its feeding position to its nonfeeding position.

In a further aspect of the present invention the sheet edge guide is mounted in a mounting slot and rails on the sheet cassette.

In a further aspect of the present invention the switch actuators are of sizes and in a pattern designed to enable the sheet size detection for a plurality of sheet sizes.

In a further aspect of the present invention the actuator arm with the plurality of switch actuators is removable from the sheet edge guide and replaceable with a different actuator arm having actuators of different sizes and in a different pattern.

In the further aspect of the present invention the actuators are flexible springs which are selectively engageable with switches on a circuit board in the main body of the apparatus.

In a further aspect of the present invention a second movable sheet edge guide perpendicular to said at least one sheet edge guide which has attached thereto at least one switch actuator is provided.

In a further aspect of the present invention the sheet cassette is removable from the sheet feeding apparatus which comprises an automatic printing machine, including means for printing an image on a sheet.

In a further aspect of the present invention the switches are mechanical contact circuit board switches.

For a better understanding of the invention as well as other objects and further features thereof, reference is had to the following drawings and description.

DESCRIPTION OF THE PREFERRED EMBODIMENT

The invention will now be described by reference to a preferred embodiment.

Figure 2:
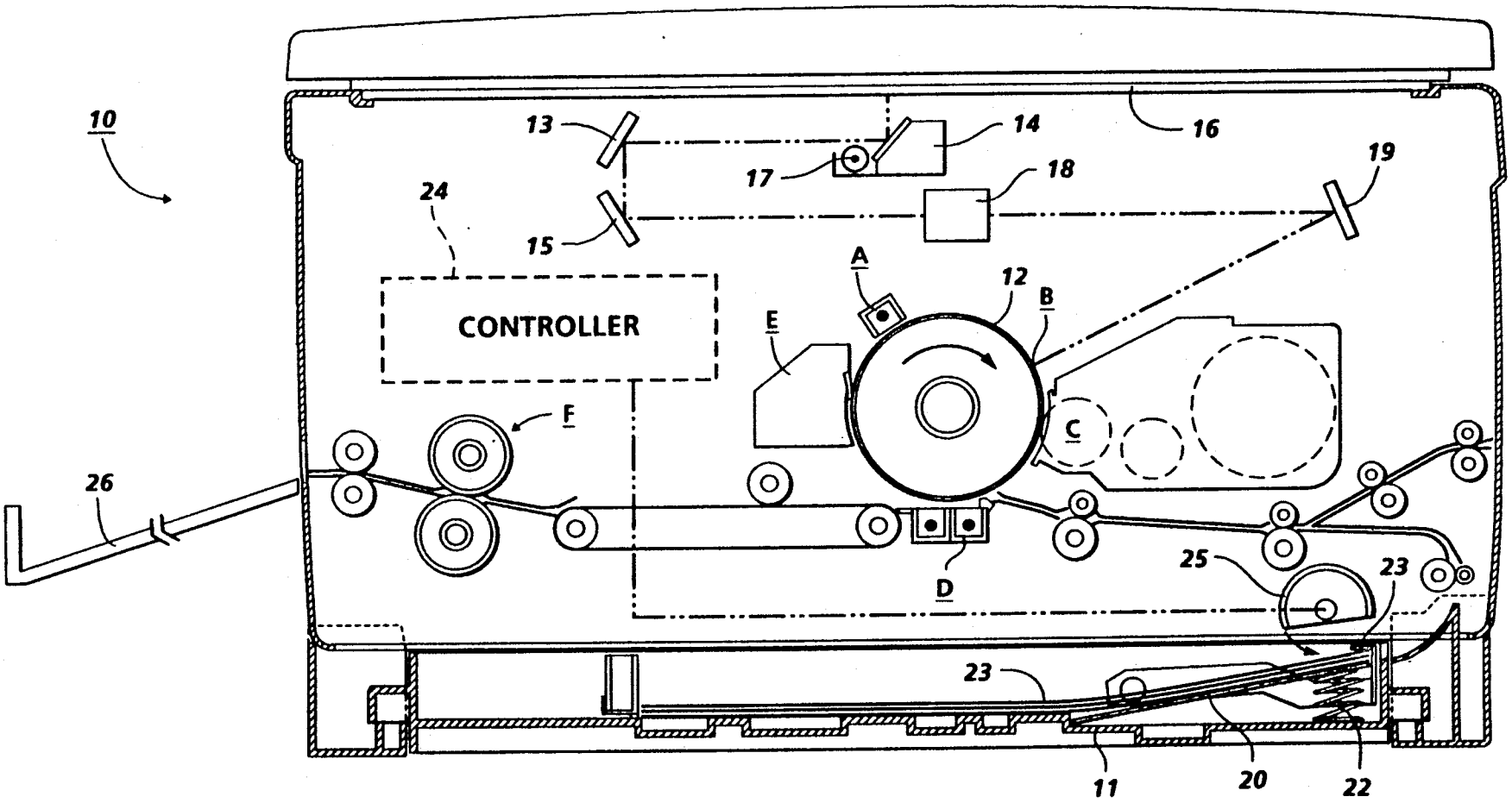
FIG. 2 is a schematic representation of an automatic printing machine having the sheet cassette according to the present invention.

Referring initially to FIG. 2, there is shown an automatic xerographic printing machine 10 including the adjustable sheet cassette 11, according to the present invention. Although the present invention is particularly well suited for use in automatic xerographic apparatus, it is equally well adapted for use with any number of other devices in which cut sheets of material are fed from a sheet supply source. The printer includes a photosensitive drum 12 which is rotated in the direction indicated by the arrow to pass sequentially through a series of xerographic processing stations; a charging station A, an imaging station B, a developer station C, a transfer station D and a cleaning station E.

A document to be reproduced is placed on imaging platen 16 and scanned by moving optical system 14 including a lamp 17 and mirrors 13 and 15 and lens 18 to produce a flowing light image on the drum surface which had been charged at charging station A. The image is then developed at development station C to form a visible toner image. The adjustable sheet cassette 11 according to the present invention is inserted from the front of the machine into the plane of FIG. 2 in the direction illustrated by arrow 21 in FIG. 1. The stack of sheets is supported in the cassette 11 by sheet stack support platform 20 which is urged upwardly by two springs 22 on each side of the front end toward the feed roll 25 and into contact with corner snubber 23. The feeding of sheets is actuated by the controller 24 to feed a sheet from the cassette by actuating segmented sheet feed roll 17 to feed a sheet to registration rolls 25 in synchronous relationship with the image on the drum surface to the transfer station D. Following transfer of the toner image to the copy sheet, the copy sheet is stripped from the drum surface and directed to the fusing station F to fuse the toner image on the copy sheet after which the drum surface itself continues to the cleaning station E where residual toner remaining on the drum surface is removed prior to the drum surface again being charged at charging station A. Upon leaving the fuser, the copy sheet with the fixed toner image thereon is transported to sheet collecting tray 26.

The practice of xerography is well known in the art and is the subject of numerous patents and texts including Electrophotography by Schaeffert and Xerography and Related Processes by Dessauer and Clark, both published in 1965 by Focal Press.

Figure 3:
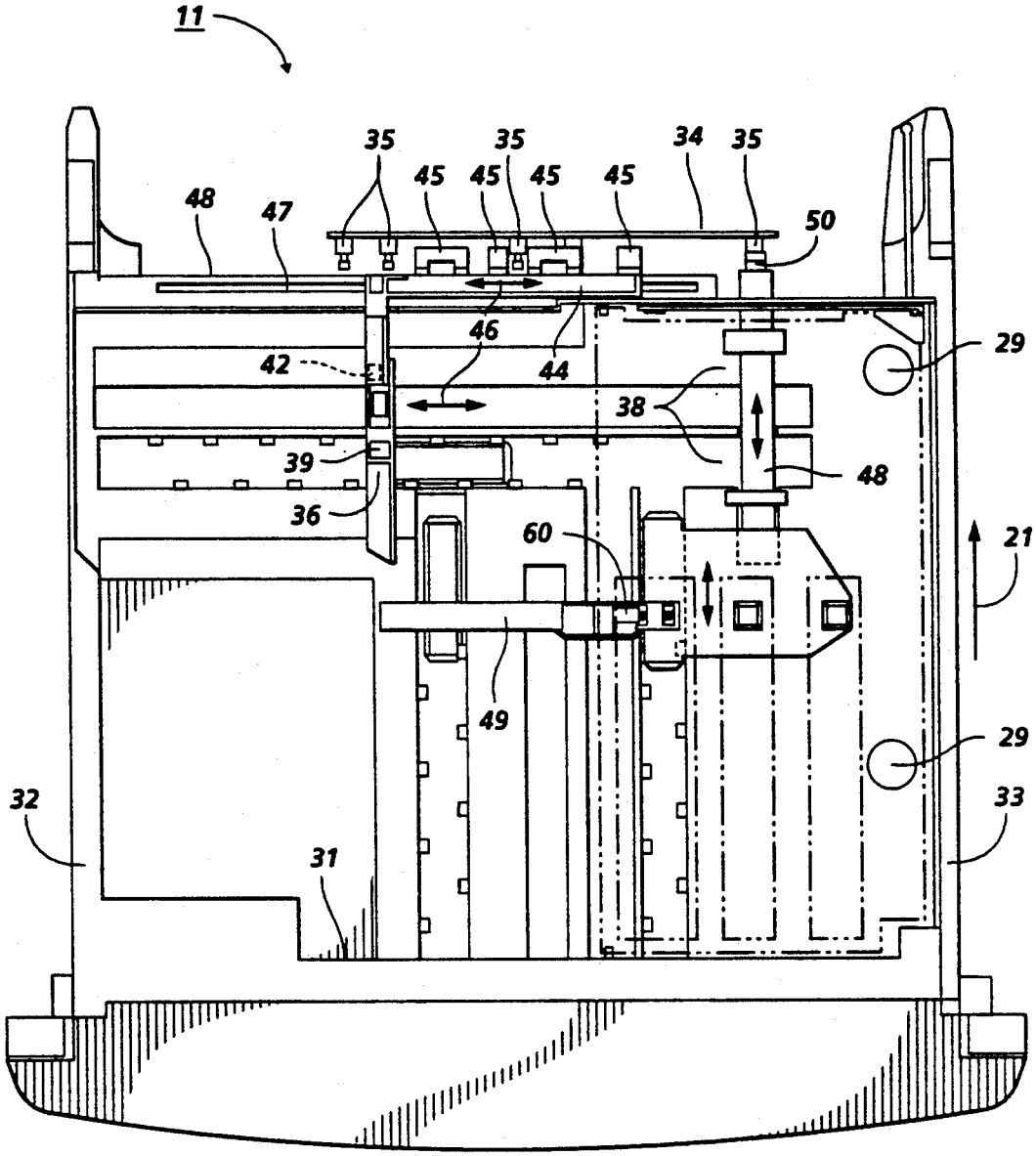
FIG. 3 is a top view of the automatic sheet size sensing cassette according to the present invention.
Figure 4:
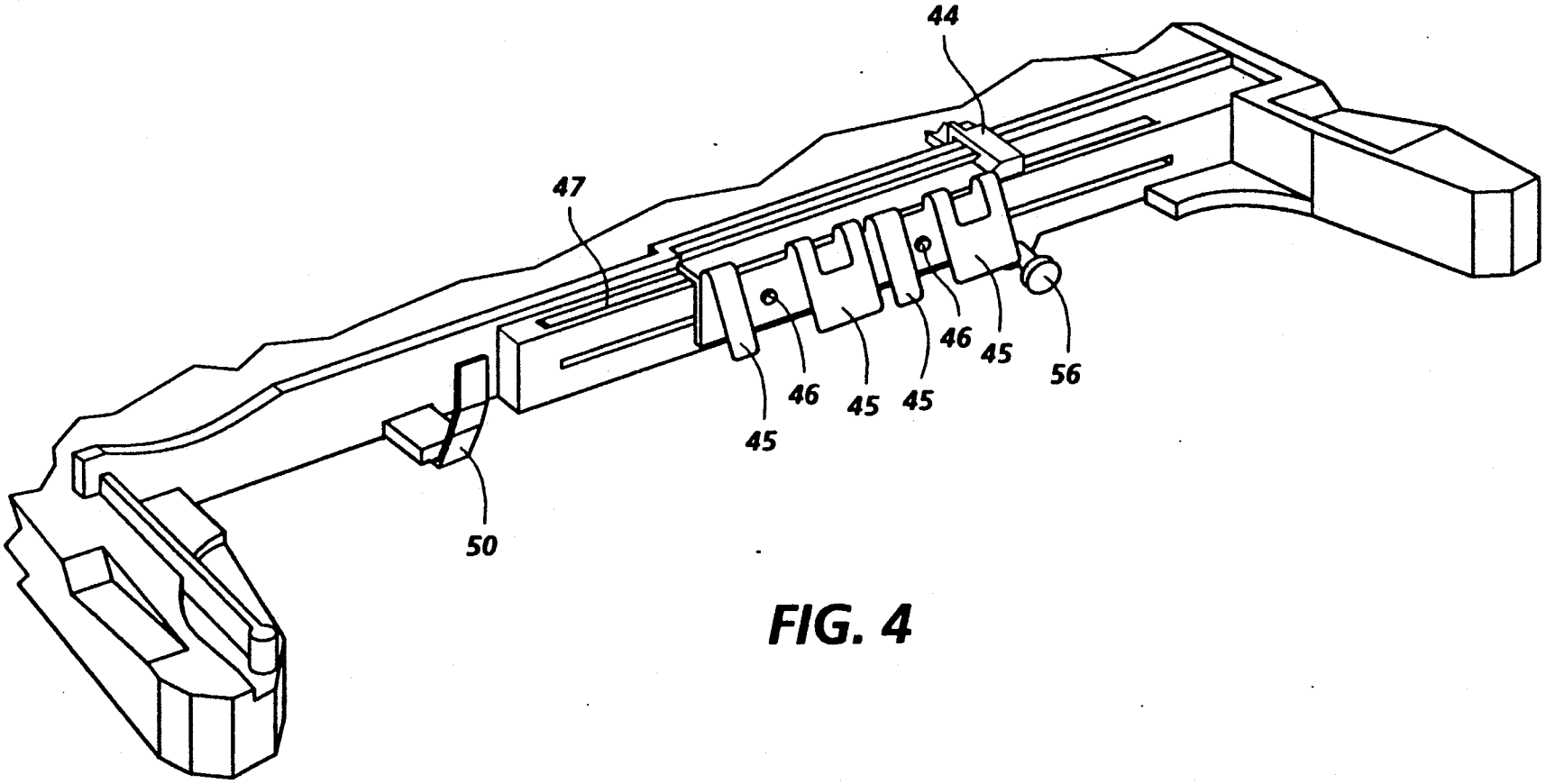
FIG. 4 is an isometric view of the sheet cassette according to the present invention illustrating the second switch actuator which is controlled by a second movable sheet edge guide and second actuator arm.

Referring more particularly to FIGS. 1 and 3 through 6, the automatic sheet size sensing mechanism will by discussed in greater detail. The cassettes illustrated in FIGS. 1 and 3 have had the sheet support platform 20 and its supporting springs 22 removed to facilitate a better understanding of the automatic sheet size sensing mechanism used in the cassettes. Only the supporting holes 29 for the springs 22 are illustrated in FIG. 3. Typically, the cassette or drawer bottom is of a one-piece molded plastic, which has additional plastic features incorporated therein or added thereto to such as cover 30 rear frame member 31 and side frame members 32 and 33. For ease of illustration, FIGS. 1 and 3 also illustrate the circuit board 34 with the associated switches 35 that is permanently fixed to the main body of the printing apparatus 10. While the switches 35 may be of any suitable kind, pressure actuated mini-mechanical contact circuit board switches are preferred as they are easy to assemble to the circuit board and are very economical. When a stack of sheets is placed on the sheet support platform and at least one of the corners of the stack is under a corner snubber, the rear sheet edge guide 36 is moved into position in contact with the rear edge of the sheets. The sheet rear edge guide rides in a mounting slot 37 and two side rails 38 and has at its inboard end a pressure locking member 39 to hold it in place against the rear edge of the stack of sheets as well as an opening 42 (see FIG. 3) into which a protuberance 43 (see FIGS. 5A and 5B) on the actuator arm 44 may be placed to guide the actuators 45 forward and backwards in the direction of the arrow 46. The actuator arm rides back and forth attached to the rear edge guide in the direction of arrow 46 in mounting slot 47 in the inboard frame 48 of the adjustable cassette. Mounted to the actuator arm are a series of spaced actuator members 45 which may be of non-uniform size and non-uniformly spaced and are typically metal, plastic, cardboard, etc., which may be fastened to the actuator arm in any suitable manner such as by screw or rivet as illustrated in the two alternative embodiments of FIGS. 5A and 5B. The actuators may be formed on one piece of material which is bent in U-shape fashion to provide a spring-like actuating mechanism when on insertion into the main body of the machine the actuators make pressured contact with the pressure actuated switches on the circuit board in the main machine.

Figure 1:
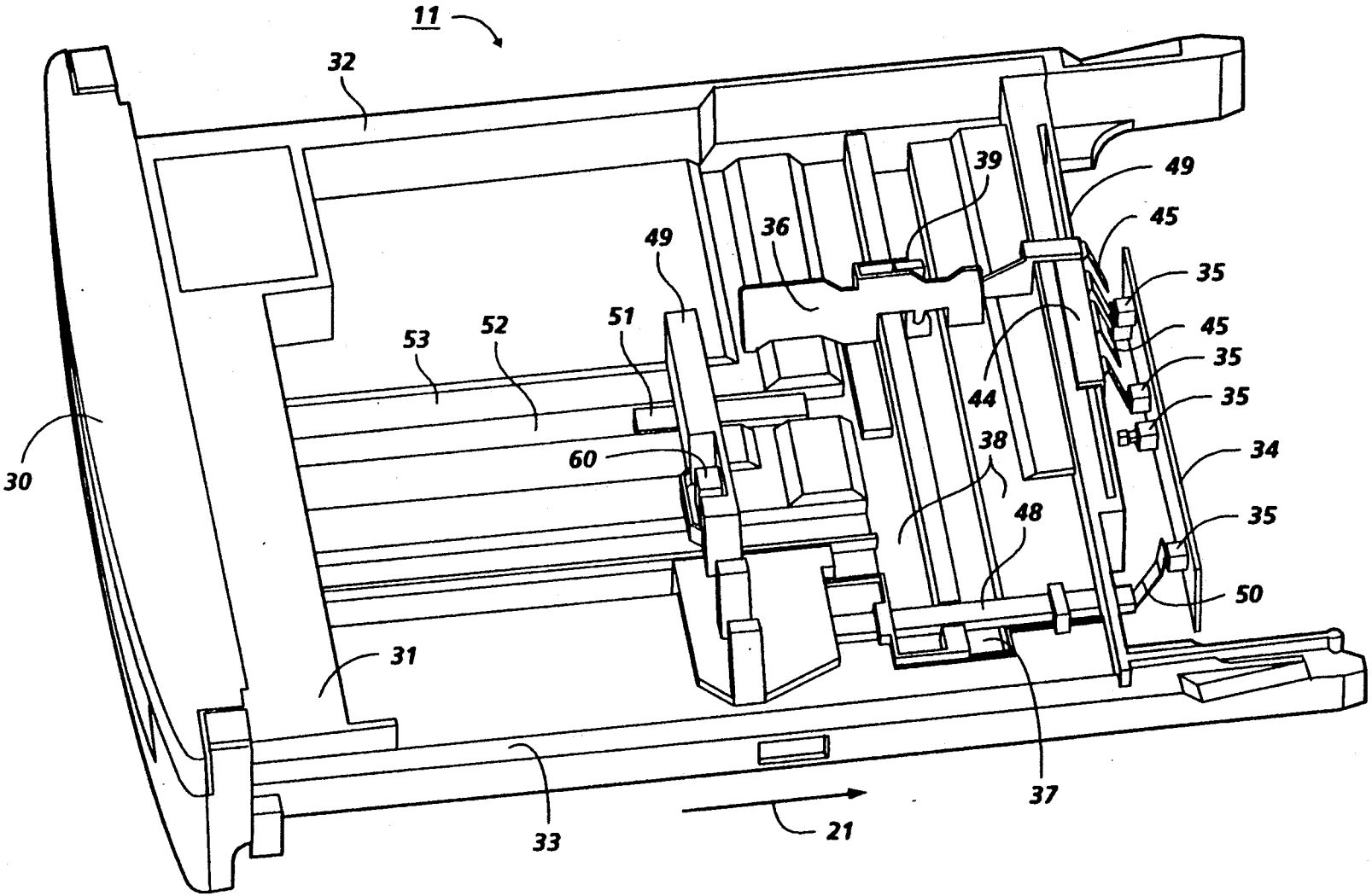
FIG. 1 is an isometric view of the adjustable sheet cassette of the present invention illustrating the automatic paper size sensing mechanism according to the present invention.
Figure 6:
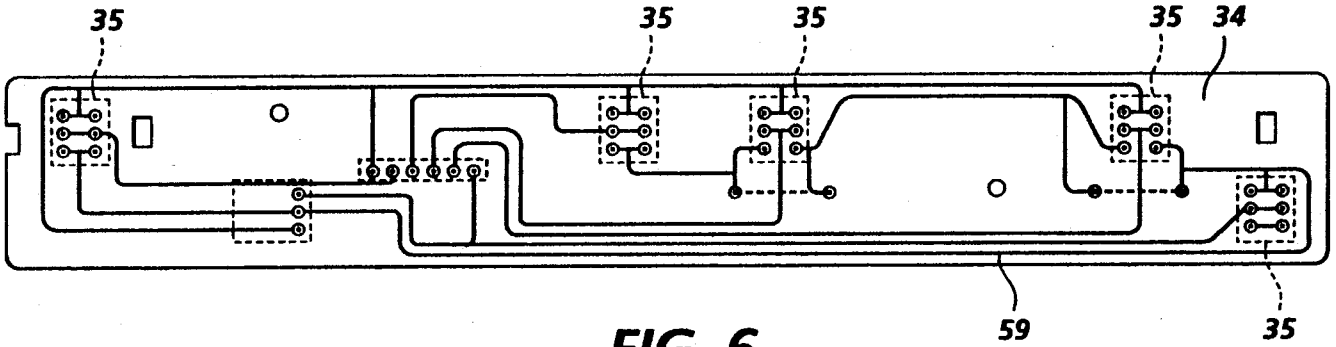
FIG. 6 schematically illustrates the circuit board on the main body of the printing apparatus with a plurality of mechanical circuit board contact switches.
Figure 5B:
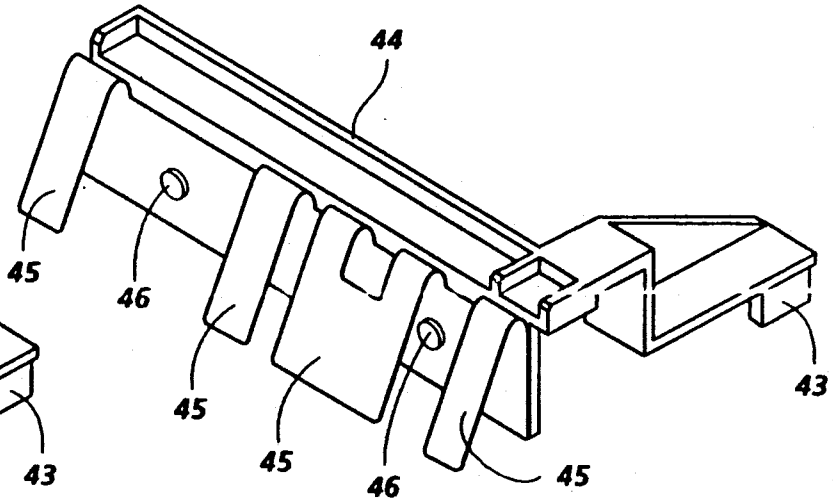
FIGS. 5*a* and 5*b* are isometric views of two alternative actuator arms that are attached to the sheet edge guide and movable therewith to selectively actuate switches on a circuit board in the main body of the printing machine.
Figure 5A:
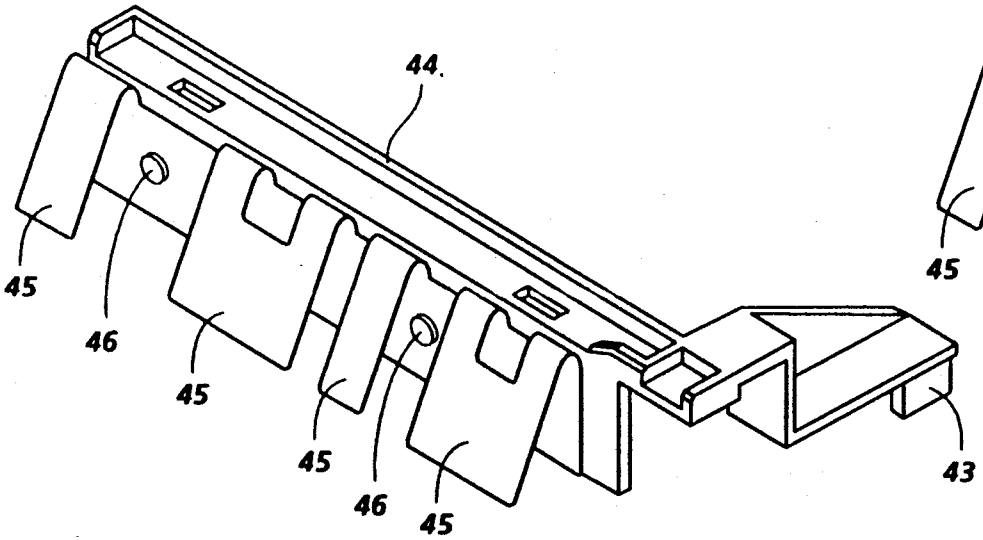

Also illustrated in FIGS. 1 and 3 is an adjustable side edge guide 49 which may be of the same general configuration as the rear edge guide in actuating switches mounted to a circuit board on the side edge of the main body of the printing apparatus. However, as illustrated herein, the actuator mechanism consists of actuator arm 48 with only one actuator 50, which is moved by the side edge guide 49 in the cassette insertion direction to make contact with one of the switches on the same circuit board that the actuators on the rear edge guide make contact with. Once again, the pressure necessary to make this contact is only that necessary to actually actuate the pressure actuated switches. It should be noted that if the side edge guide is used to actuate switches on a circuit board along the side edge of the cassette, that the individual actuator members should be curved on both ends to permit the actuators to sequentially be transported past individual switches during the cassette insertion and withdrawal procedure without breaking the end of the pressure actuated switch off or otherwise actuating the switch. By so rounding the ends of the individual actuators damage to the individual switches on insertion and withdrawal is minimized. As with the rear edge sheet guide, the side edge sheet guide have a member 51 riding in a mounting slot 52 and on rails 53 and also has a spring bias locking member 60 to hold it in place. At the front of the cassette in the cassette insertion direction there is an interlock switch 56 (see FIG. 4) which engages a switch 61 (see FIG. 7) on the main body of the machine indicating to the controller that there is a cassette in the proper position in the machine. Once in the proper position, the individual actuators will have actuated one or more of the plurality of switches on the main body of the printing apparatus which represent one of a plurality of sheet sizes. The pattern of the switches on the main body of the printing apparatus together with the pattern of the actuators, their size, number and space are designed to accommodate the paper size detections required for a variety of paper sizes. The actuators themselves can be different sizes and can be used to actuate more than one switch. Both the width of the individual actuators together with a spacing may be varied such that for practical terms there is no limit on the number or on the size of the switches and actuators. With reference to FIG. 6, which illustrates the circuit board together with the switches in dotted lines and the wiring diagram 59 the actuation of each individual switch generates a particular resistance in a variable resistor on the circuit board contributing to a total resultant resistance which defines the resultant voltage read by the controller which allows the controller to interpret the size of the sheet loaded in the cassette. Since each switch provides a unique resistance, the resultant resistance from the actuation of any combination of actuators provides a unique voltage according to the relationship $V=IR$. Below are two tables of different size sheet matrixes indicating the number and location of switch actuation for a plurality of sheet sizes which determine the unique voltage signal sent to the controller. With this mechanism of selectively activating individual switches the variable resistor acts as a digital to analog converter which sends the resultant voltage to the main controller which allows the controller to interpret the size of the paper loaded in the cassette.

| S1 | S2 | S3 | S4 | S5 | Paper Size | A/D Volts |
|---|---|---|---|---|---|---|
| | | | MULTINATIONAL TRAY SIZE MATRIX | | | |
| 1 | 0 | 0 | 0 | 0 | 11 × 17 SEF | 0.0–.176 |
| 1 | 0 | 0 | 1 | 0 | 8.5 × 11/A4 LEF | 0.38 |
| 1 | 0 | 0 | 1 | 1 | 5.5 × 8.5 SEF | |
| 1 | 0 | 1 | 0 | 0 | 8.5 × 11 SEF | 0.73 |
| 1 | 1 | 0 | 0 | 0 | 8.5 × 14 SEF | 1.46 |
| 1 | 1 | 1 | 0 | 0 | 8.5 × 13 SEF | 2.19 |
| 1 | 1 | 1 | 1 | 0 | A4SEF | 2.57 |
| 0 | X | X | X | X | TRAY OUT | Vref (3.0) |
| | | | DOMESTIC TRAY SIZE MATRIX | | | |
| 1 | 0 | 0 | 0 | 0 | A3 SEF | 0.0–.176 |
| 1 | 0 | 0 | 1 | 0 | B5 LEF | 0.38 |
| 1 | 0 | 1 | 0 | 0 | B5 SEF | 0.73 |
| 1 | 0 | 1 | 1 | 0 | A4 LEF | 1.10 |
| 1 | 0 | 1 | 1 | 1 | A4 SEF | 1.28 |
| 1 | 1 | 0 | 0 | 0 | B4 SEF | 1.46 |
| 1 | 1 | 1 | 0 | 0 | A4 SEF | 21.9 |
| 0 | X | X | X | X | TRAY OUT | Vref (3.0) |

1 = SWITCH ACTUATED
0 = SWITCH NOT ACTUATED
X = DON'T CARE

In the tables SEF means short edge feed and LEF means long edge feed. The column labeled A/D Volts represents the resultant analog to digital voltage signal transmitted to the main controller. $V_{ref}$ is the reference voltage when the tray or cassette is out of the main body of the machine.

Figure 7:
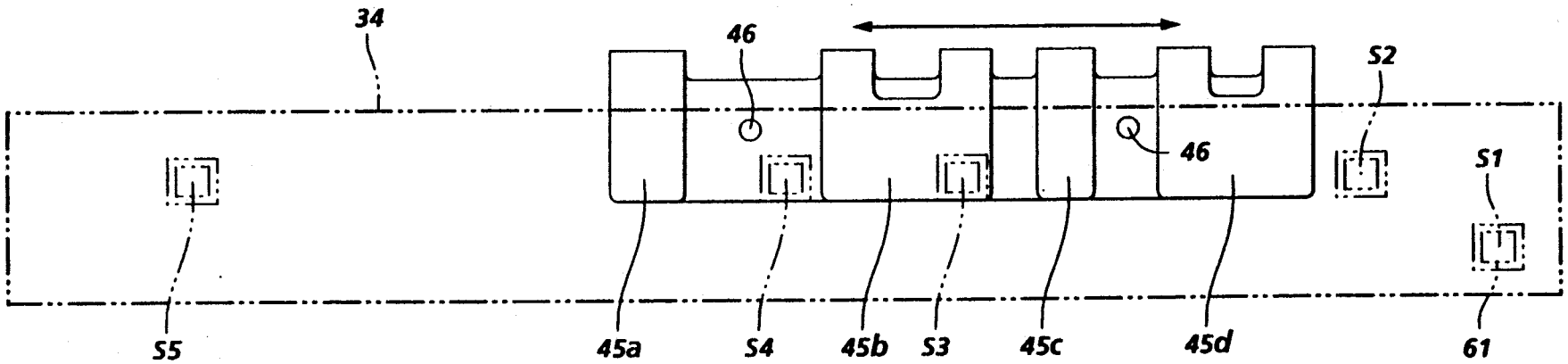
FIG. 7 schematically illustrates the movable actuator arm in solid line with the switches on the circuit board in phantom in position setting for 8½"×11" sheets.

Attention is now directed to FIG. 7 where the actuators 45 on the actuator arm may be moved back and forth in the direction of the arrow while the switches 35 remain stationary on the circuit board. This figure is representative of the spatial relationship between actuators and switches for 8½"×11" sheets SEF and the width of 45*a* is 11.5 mm, 45*b* is 76 mm, 45*c* is 9 mm and 45*d* is 23 mm and the spacing between 45*a* and 45*b* is 21 mm and the spacing between 45*b* and 45*c* is 6.5 mm and the spacing between 45*c* and 45*d* is 10 mm. In FIG. 7, switch 61 is S1, in the table and is always actuated when the cassette is fully inserted into the machine. The other switches 35 have been designated as S2, S3, S4 and S5. The centerline spacing between S1 and S2 is 22.9 mm, between S2 and S3 is 66 mm, between S3 and S4 is 29.2 mm and between S4 and S5 is 100.6 mm. As may be observed in FIG. 7 for 8½×11" SEF sheets only S1 and S3 are actuated which corresponds to the above table.

While the switches may be fixed in position on the circuit board on the main body of the printing apparatus, the actuator arms may be removed from the sheet edge guide and replaced by a different actuator arm, having a different pattern spacing, width, length of actuator members, to engage the same set of switches in a different combination for a different combination of sheet sizing. This interchangeability of the actuator arms enables the automatic paper sheet size sensing mechanism according to the present invention to be used for various commercial markets, having different commonly used paper sizes.

Thus, according to the present invention an automatic sheet size sensing mechanism of greatly improved reliability is provided by preventing a situation where the machine does not know what size paper is in the sheet cassette. All common sheet sizes can be interpreted with the use of this mechanism which can also accommodate other noncommon sizes. The present invention also provides an economical interchangeable replaceable actuator assembly where the size sensing cassette can be used for and retrofitted for multinational, Japanese, American, paper sizes. It enables the controller on the main body of the apparatus to interpret what size paper is loaded in a cassette and therefore enables automatic reduction and enlargement as well as automatic size selection and match copy size to original size. Furthermore, the mini-mechanical contact circuit board switches, which in addition to being economical also provide a mechanism more immuned to contamination than one based on electrical devices.

The patents and text referred to specifically in this application are hereby incorporated herein by reference in their entirety in to the present application.

Thus, according to the present invention a simple, economical adjustable sheet cassette with no electrical harnessing between the cassette and the main body of the machine is provided. Furthermore, while the invention has been described with regard to electrostatographic printing apparatus, it will be understood that it has equal application to other types of printing and sheet handling devices. In addition, while the invention has been illustrated with a forward buckle-over snubbers sheet feeder device in a relatively small, low speed apparatus, it has equal applicability to other types of feeders such as vacuum corrugated feeders, friction retard feeders, etc., and has equal application in larger, more sophisticated, higher speed, higher volume machines. Accordingly, it is intended to embrace all such alternatives and modifications as may fall within the spirit and scope of the appending claims.

We claim:

1. An adjustable sheet cassette for use in the main body of a machine, said cassette comprising means for feeding sheets therefrom and being movable in said machine from a sheet feeding position to a nonsheet feeding position, said adjustable sheet cassette comprising a sheet stack support platform capable of supporting stacks of sheets of a plurality of length and width dimensions, at least one sheet edge guide movable in a path in said cassette to accommodate stacks of sheets of different length or width dimensions, said sheet edge guide having attached thereto an actuator arm having a plurality of flexible spring switch actuators for selectively actuating a plurality of switches on a circuit board on the main body of the machine when said cassette is in sheet feeding position in said machine, said actuators being located to selectively actuate the switches on the main body of the machine which represent one of a plurality of sheet sizes, whereby when each of said switches is actuated it generates a unique resistance in the circuit on the circuit board, the resultant of these unique resistances determining a resultant voltage signal to a controller on the main body of the machine which allows the controller to interpret the length or width dimension of the sheets in the sheet cassette.

2. The cassette of claim 1 wherein said actuators are on an actuator arm which is attached to said sheet edge guide and is movable in a path parallel to the path of motion of said sheet edge guide.

3. The cassette of claim 2 wherein said path of motion of said sheet edge guide is perpendicular to the path of motion of said sheet cassette from its feeding position to its nonfeeding position.

4. The cassette of claim 1 further including a mounting slot and at least one rail and wherein said sheet edge guide is mounted in said slot and on said at least one rail.

5. The cassette of claim 1 wherein said switch actuators are of sizes and in a pattern designed to enable sheet size detection for a plurality of sheet sizes.

6. The cassette of claim 5 wherein said actuator arm with said plurality of switch actuators is removable from said sheet edge guide and replaceable with a different actuator arm having actuators of different sizes and in a different pattern.

7. The cassette of claim 1 wherein said cassette is removable from said machine.

8. The cassette of claim 3 including a second movable sheet edge guide perpendicular to said at least one sheet edge guide and has attached thereto at least one switch actuator.

9. An automatic printing machine having a main body and including means for printing an image on a sheet, an adjustable sheet cassette, means for feeding a sheet from said cassette, said sheet cassette being movable in said machine from a sheet feeding position to a non sheet feeding position, said adjustable sheet cassette comprising a sheet stack support platform capable of supporting stacks of sheets of a plurality of length and width dimensions, at least one sheet edge guide movable in a path in said cassette to accommodate stacks of sheets of different length or width dimensions, said sheet edge guide having attached thereto an actuator arm having a plurality of switch actuators said machine having mounted thereto a circuit board having a plurality of switches, said switch actuators selectively actuating the switches on the circuit board on the main body of the machine when said cassette is in sheet feeding position in said machine, said actuators being located to selectively actuate the switches on the main body of the machine which represent one of a plurality of sheet sizes, each of said switches when actuated generating a unique resistance in the circuit on said circuit board, the resultant of said unique resistances determining a resultant voltage signal to a controller on the main body of the machine which allows the controller to interpret the length or width dimension of the sheets in the sheet cassette.

10. The machine of claim 9 wherein said switches are mechanical contact circuit board switches.

11. The machine of claim 9 wherein said actuators are movable in a path parallel to the path of motion of said sheet edge guide.

12. The machine of claim 11 wherein said path of motion of said sheet edge guide is perpendicular to the path of motion of said sheet cassette from its feeding position to its nonfeeding position.

13. The machine of claim 9 further including a mounting slot and at least one rail and wherein said sheet edge guide is mounted in said slot and on at least one rail.

14. The machine of claim 9 wherein said switch actuators are of sizes and in a pattern designed to enable sheet size detection for a plurality of sheet sizes.

15. The machine of claim 14 wherein said actuator arm with said plurality of switch actuators is removable from said sheet edge guide and replaceable with a different actuator arm having actuators of different sizes and in a different pattern.

16. The machine of claim 9 wherein said cassette is removable from said machine.

17. The machine of claim 9 wherein said actuators are flexible springs which are selectively engageable with the switches on the circuit board on the main body of the machine.

18. The machine of claim 11 including a second movable sheet edge guide perpendicular to said at least one sheet edge guide and has attached thereto at least one switch actuator.

* * * * *